United States Patent [19]

Massa et al.

[11] Patent Number: 5,035,924

[45] Date of Patent: Jul. 30, 1991

[54] PROCESS FOR METALLIZING FIBROUS MATERIALS

[75] Inventors: Vincenzo Massa, Busto Arsizio; Fabrizio Merlo, Saronno; Uberto Casolo Ginelli, Somma Lombardo, all of Italy

[73] Assignee: Himont Italia S.r.l., Milan, Italy

[21] Appl. No.: 500,120

[22] Filed: Mar. 27, 1990

Related U.S. Application Data

[63] Continuation of Ser. No. 304,250, Jan. 31, 1989, abandoned.

[30] Foreign Application Priority Data

Feb. 1, 1988 [IT] Italy ..... 19262 A/88

[51] Int. Cl.[5] ..... B05D 3/00

[52] U.S. Cl. ..... 427/299; 427/305; 427/306; 427/322; 427/324; 427/404; 427/412

[58] Field of Search ..... 427/322, 323, 324, 404, 427/412, 299, 305, 306

[56] References Cited

U.S. PATENT DOCUMENTS 4,308,094 12/1981 Miyoshi et al. ..... 427/404 X

*Primary Examiner*—Michael Lusignan

*Attorney, Agent, or Firm*—Stevens, Davis, Miller & Mosher

[57] ABSTRACT

Method for the electroless metallizing of fibrous materials, consisting of coating such fibrous materials, before subjecting them to a chemical metallizing treatment, with a uniform film of a polymer which is capable of adhering to the fibrous material, is resistant to the chemical metallizing treatment, and is suitable for receiving metal coatings.

7 Claims, No Drawings

PROCESS FOR METALLIZING FIBROUS MATERIALS

This application is a continuation of application Ser. No. 304,250, filed Jan. 31, 1989, now abandoned.

DESCRIPTION OF THE INVENTION

The present invention relates to a process for the metallizing of fibrous materials.

It is known that the metallizing of fibrous materials endows said fibrous materials with electrical, magnetic and thermal properties which are necessary in order to endow the finished articles with high-level antistatic characteristics, radio waves reflection factor, electromagnetic radiation shielding effectiveness, heat conductivity, and so forth.

Metallizing by a chemical route, possibly followed by an electrochemical metallizing, turns out to be advantageous as compared to other techniques, such as vacuum metallizing or arc-spray metal coating, in that it allows a higher flexibility to be achieved in the production processes, while simultaneously giving better quality products (characterized, e.g., by a higher adhesion strength of metal to the fiber, a higher wear resistance, a longer useful life, and so forth).

Unfortunately, fibrous materials exist which, either owing to their nature, or due to their structure, are not adapted to a chemical metallizing treatment.

As to the nature of the fiber, the drawbacks and difficulties derive either from the insufficient adhesive strength of the metal to the fiber (e.g., in case of polypropylene fibers), or from the sensitivity to strongly acidic or alkaline metallizing baths (e.g., in case of polyester or cellulosic fibers), or from the lack in homogeneity of characteristics (as occurs, e.g., in the case of blends of different fibers).

As to the structure, the quality of the results is influenced by the degree of structural homogeneity of the fibrous material. For example, in the case of fabrics made from raffias or from high-count threads (20 dtex or more), the weaving interlacings may cause such shielding effects as to endanger the reactions of surface activation during the electroless treatment step, leading to different values of conductivity from point to point, which, among other things, hinders a subsequent galvanic treatment.

Another example is the case of non-woven articles (including waddings, needle-punched felts, dermoporous felts, and so forth) obtained from staple without passing through the thread step, according to dry web production techniques (for example, rando-webber), or wet web production routes (technologies of the paper production type).

The manufacture of these articles leads to considerable unevennesses due to the formation step (cloudiness; differences between the upper and lower sides, between the core and the outer surfaces, between the machine direction and the cross direction, and so forth), and to the step of mechanical, chemical or thermal binding (mechanical damaging of the fibers, irregular depositions of adhesive, melting areas, and so forth).

Each one of the above-cited phenomena has a negative influence on the chemical deposition of metal on the fibrous surface, causing covering faults, and/or defects due to insufficient adhesive strength, and/or defects due to alterations in the kinetics of growth of the crystalline metal layer.

The pre-treatment of surfaces of films or fibers to be subjected to metallizing by an electroless chemical route by subjecting said surfaces to a graft-polymerization, is known from the prior art.

For example, JP-A-79/116,066 discloses the graft-polymerization of maleic anhydride onto a polyethylene or polypropylene film, which are subsequently subjected to a metal (Ni) coating by a chemical route, and later on by an electrolytic process.

JP-A-83/196,238 discloses plastic surfaces activated in order to enhance the adhesion strength of metal layers applied by an electroless chemical route, wherein said activation consists in a graft-polymerization of acrylic acid onto a poly(ethylene terephthalate) film.

In both cases, the applied metal layer shows good mechanical strength and good adhesion strength, in contract to metals applied in the same way but on non-grafted films.

However, these methods suffer from certain disadvantages due to the fact that the surfaces are treated with very reactive chemical agents, such as acrylic acid and maleic anhydride, which cause problems of toxicity. Another drawback is the fact that, inasmuch as the treatment of the surface is a true chemical reaction, the installation of specific equipment, and hence a more complex technology, is required.

JP-A-85/239,234 discloses, on the contrary, the treatment of fibrous materials with poly(vinyl alcohol) before said fibrous materials are subjected to an electroless metallizing.

Unfortunately, even with this treatment satisfactory results cannot be achieved, particularly as regards the homogeneity and/or the integrity of the metal coating thus obtained.

In accordance with the present invention, it has, surprisingly, been discovered that the above-mentioned problems may be overcome by resorting to suitable preformed polymers which are capable of adhering well to the fibrous material.

The use of such polymers makes it possible as well to avoid the use of highly toxic materials, with at the same time the use of very simplified technologies.

The object of the present invention is therefore a process for the metallizing of fibrous materials by a chemical route, which consists essentially in uniformly coating such fibrous materials with a continuous, well-anchored film, resistant to the chemical treatments required by the metallizing, said film being constituted by a polymer which is capable of adhering well to the fibrous material, and which is suitable for receiving metal coatings.

The polymers according to the present invention are used as aqueous dispersions, or as solutions or dispersions in organic solvents, but they are preferably used as aqueous dispersions, or anyway water-dilutable dispersions (usually available in the market at concentrations within the range of from 30% to 60%), which, by simply removing the dispersing medium at room temperature, or at temperatures within the range of from 0° to 60°-70° C., and preferably from 50° to 70° C., generate the above said continuous and uniform polymeric films.

Many water-dispersible synthetic polymers have been shown to be suitable for the purposes of the present invention: among these, polymers based on either homopolymerized or copolymerized vinyl acetate, vinyl propionate, styrene, -methyl-styrene, acrylonitrile, ($C_1$-$C_8$)-alkyl acrylates and methacrylates, butadiene, with or without functional groups of the OH, COOH, CN, $NH_2$ or $CONH_2$ type—this latter being possibly either methylolated or methoxylated—may be cited. Water-dispersed polymers of the polyurethane-type may be mentioned as well. All of the above-mentioned polymers are types readily available on the market.

The application of said polymers onto the fibrous material is carried out according to the technologies used in the textile industry for finishing, such as, e.g., full-bath impregnation, tangential-roll impregnation, spraying, spreading, etc., followed by the removal of the aqueous medium by drying, possibly preceded by a wringing, or by a removal of the excess of the bath by suction.

As to the operating conditions, the use formulations and the application modalities, these are defined from case to case as a function of the fibrous materials treated, of the selected polymer, and of the equipment used, according to criteria well-known to those skilled in the art, so as to produce on the fibers film deposits which are as continuous, uniform and thin as possible.

The uniformity and continuity of the film are in fact essential in order to insure the protection of the fibers from the metallizing baths, and to guarantee that the deposition of the metal coating takes place in a uniform way at every individual point of the fibrous material.

However, the amount of polymeric material applied should be kept as small as possible, in order not to alter more than necessary the characteristics of cohesion, hand and stiffness of the fabricated article used as the starting material.

The fibrous material used as the metallizing substrate may be constituted by natural, artificial or synthetic fibers (cellulose fibers, polyacrylonitrile fibers, polyester fibers, polyamide fibers, polyolefine fibers, and so forth), practically with no exceptions, including advanced organic fibers (e.g., the aramide fibers), as well as inorganic fibers (e.g., carbon fibers, fiberglass, asbestos). As to the nature of the fibrous material, this can be in the form of practically any type of fabrics such as knitted fabrics or non-woven fabrics.

In principle, no preliminary treatments of the fibrous substrates are necessary before the anchoring polymeric material is applied. Usually, preliminarily verifying the suitability of said polymeric material for the specific substrate used, so as to be able to select a type capable of securing the desired coating effect, will be enough.

In order still better to understand the present invention, and to allow it to be practiced, some examples are reported below merely for illustrative, non-limitative purposes, which show the preparation of fibrous materials metallized by the process according to the present invention.

EXAMPLE 1

A non-woven fabric of polyacrylonitrile fiber, with a weight of 30 g/m$^2$, is impregnated with a water-dispersed acrylic resin based on butyl acrylate and acrylonitrile, such as, e.g., CRILAT® DR 1467 by ROL, diluted with water down to a concentration of 15% by weight, in the presence of a non-ionic wetting agent (e.g., POLIROL® NF80 by ROL), and is subsequently wrung between two rolls under a pressure of 1-2 atm. The fabric is then dried with air at 60°-70° C. and is subsequently heated to, and maintained for 1-5 minutes, at a temperature of 120°-150° C., in order to attain the cross-linking of the resin.

The so-obtained fabric is then sensitized by being dipped for a time of from 5 to 10 minutes in a solution containing 15 g/liter of $SnCl_2.2H_2O$, in the presence of HCl at 2% (pH 1-1.5), thoroughly rinsed with $H_2O$, and activated by means of a treatment for a time of from 3 to 5 minutes in a solution containing 0.3 g/liter of $PdCl_2$ in the presence of HCl at 0.2% (pH 2-2.5).

After being rinsed with water, the fabric is treated for 30 minutes at room temperature inside a copper bath: this bath contains 5 g/liter of $CuSO_4.5H_2O$, 25 g/liter of sodium-potassium tartrate tetrahydrate, 7 g/liter of sodium hydroxide, 11 g/liter of formaldehyde at 40%, and 0.1 g/liter of sodium lauryl-sulphate. The pH value of the bath is about 13. Air is bubbled through the bath under a pressure of 1 atm. The fabric absorbs about 4 g/m$^2$ of copper, and has a surface resistivity of about 0.1 Ω.

The fabric is then subjected for 1-5 minutes to an electrodeposition of nickel inside an electrolytic cell with nickel anodes, at a temperature of 50°-70° C., and at a pH of 1.2-1.5, with a current density of 1-5 A/dm$^2$. The bath contains 300 g/liter of nickel chloride hexahydrate, 30 g/liter of boric acid, and 0.7 g/liter of saccharin. The bath is maintained at an acidic pH value by means of controlled additions of HCl at 15%.

The fabric absorbs from 4 to 15 g/m$^2$ of nickel, according to the residence time and the current density, with a uniform distribution and a perfect adhesion. The surface resistivity of the fabric is 0.02-0.1 Ω. The fabric is endowed with a shielding effectiveness for electromagnetic radiations of 60-70 dB within the range of frequencies of from 10 kHz to 12 GHz.

EXAMPLE 2

A non-woven fabric of polyacrylonitrile fiber, of a weight of 40 g/m$^2$, is respectively impregnated with an acetovinylic resin, e.g., VINAVIL® HC by ROL, diluted with water down to a concentration of 20% by weight, or with a butadiene-acrylonitrile resin, e.g., PERBUNAN® NT by BAYER, diluted with water down to a concentration of 20% by weight, in the presence of a non-ionic wetting agent (e.g., POLIROL® NF80 by ROL), and is subsequently wrung between two rolls under a pressure of 1 atm. The fabric is then dried with air at 60°-70° C., and is subsequently heated to, and maintained at, a temperature of 120°-130° C. for 2-3 minutes. Both said non-woven fabrics, respectively impregnated with the polyvinylic resin and with the polybutadienic resin were subjected to an electroless copper deposition, and to a subsequent electrocoating with nickel according to modalites analogous to procedures of Example 1. They display a surface resistivity of 0.02-0.1 Ω, and a shielding effectiveness of 60-70 dB within the range of frequencies of from 10 kHz to 12 GHz.

EXAMPLE 3

A non-woven fabric of polyester fiber, having a weight of 10 g/m$^2$, is impregnated with a polyacrylic resin as disclosed in Example 1 and is subsequently subjected to an electroless deposition of copper and to a subsequent electrodeposition of nickel, as disclosed in Example 1.

The surface resistivity is 0.1-0.4 Ω, and the shielding effectiveness is 50-60 dB with the range of frequencies of from 10 kHz to 12 GHz.

EXAMPLE 4

A fabric of polyester fiber, with a weight of 24 g/m$^2$, is impregnated with a water-dispersed polyurethane resin, e.g., PURBINDER ® DPT or PA 531 (in foreign countries, the product is known under the trademark ITALPUR ®) by ROL, and diluted with water down to a concentration of 20% by weight. The fabric is dried at 60°-70° C. for 30-40 minutes, then, after being sensitized and activated in the same way as in Example 1, an electroless deposition of copper and a subsequent electrodeposition of nickel are carried out on it, as disclosed in Example 1.

The surface resistivity is 0.5-1 Ω, and the shielding effectiveness is 45-50 dB at frequencies within the range of from 10 kHz to 12 GHz.

EXAMPLE 5

A fabric of polyester fiber, with a weight of 50 g/m$^2$, is impregnated with a polyacrylic resin, e.g. CRILAT ® DR 1467 by ROL, according to the same procedure as in Example 1.

The fabric, after being sensitized with $SnCl_2$, and activated with $PdCl_2$, according to the same procedures as in Example 1, is treated for 15 minutes at 70°-80° C. in a nickel bath: this bath contains 30 g/liter of nickel chloride hexahydrate, 10 g/liter of monosodium hypophosphite monohydrate, and 35 g/liter of hydroxyacetic acid.

The pH value of the bath is maintained within the range of from 4 to 5 by means of gradual additions of an NaOH solution at 10%.

The fabric absorbs about 8 g/m$^2$ of nickel, has a surface resistivity of about 0.2 Ω, and its shielding effectiveness is about 55 dB within the range of frequencies of from 10 kHz to 12 GHz.

EXAMPLE 6

A non-woven fiberglass fabric by VETROTEX, having a weight of 450 g/m$^2$, is impregnated with a water-dispersed polyurethane resin, e.g., PURBINDER ® DPT or PA 531 (in foreign countries, ITALPUR ®) by ROL, diluted with water down to a concentration of 25% by weight.

The impregnated article is heated at 60°-70° C. for 30 minutes, then is subjected to an electroless deposition of copper and to a subsequent electrodeposition of nickel, as disclosed in Example 1.

The surface resistivity is 0.1-0.5 Ω, and the shielding effectiveness is 50-60 dB at frequency values within the range of from 10 kHz to 12 GHz.

EXAMPLE 7

A non-woven fabric of fiberglass, analogous to the one used in Example 6, is impregnated with a polyacrylic resin, e.g., CRILAT ® DR 1467 by ROL, according to the same procedures as disclosed in Example 1.

The impregnated article, after being sensitized with $SnCl_2$ and activated with $PdCl_2$, according to the same procedures as in Example 1, is subjected to an electroless deposition of nickel, in a bath which has the same composition as that of Example 5.

The article absorbs about 12 g/m$^2$ of nickel, and has a surface resistivity of about 0.2 Ω.

The shielding effectiveness is about 55 dB within the range of frequencies of from 10 kHz to 12 GHz.

EXAMPLE 8

A fabric of poly-p-phenylene-terephthalamide fiber (e.g., KEVLAR ® by DUPONT), with a weight of 80 g/m$^2$, is treated with a solution of NaOH at 5% at 40° C. for 10-15 minutes, washed with water and is impregnated with a polyurethane resin, e.g., PURBINDER ® PA 531 by ROL. The fabric is heated at 60°-70° C. for 40-60 minutes, then, after having been sensitized with $SnCl_2$ and activated with $PdCl_2$ according to Example 1, is treated for 30 minutes at 70°-80° C. in a bath of nickel: this bath contains 30 g/liter of nickel chloride hexahydrate, 10 g/liter of monosodium hypophosphite monohydrate, 12.6 g/liter of sodium citrate dihydrate, and 5 g/liter of sodium acetate. The pH of the bath in maintained at a value within the range of from 4.5 to 5.5 by addition of suitable amounts of a solution of NaOH at 10%. The fabric absorbs about 16 g/m$^2$ of nickel, with a surface resistivity of about 0.2 Ω.

The shielding effectiveness is about 55 dB at frequencies within the range of from 10 kHz to 12 GHz.

What is claimed is:

1. Method for the metallizing of fibrous materials by means of a chemical route, characterized in that said fibrous materials, before being subjected to the normal chemical treatment for metallizing, are uniformly coated with a continuous film of a polymer, which is capable of adhering to the fibrous material, is resistant to the chemical metallizing treatment, and is capable of receiving metal coatings, said polymer being selected from the group consisting of homopolymerized or copolymerized vinyl propionate, styrene, alpha-methylstyrene, butadiene, with or without functional groups —OH, —COOH, —CN, —$NH_2$ or —$CONH_2$ type, this latter being optionally either methylolated or methoxylated, or a polymer of polyurethane nature, and thereafter metallizing said coated fibrous material.

2. Method according to claim 1, characterized in that the film is formed by means of the application onto the fibrous material of the polymer as an aqueous dispersion, or as a solution or dispersion in organic solvents.

3. Method according to claim 1 or 2, characterized in that the film is formed by applying onto the fibrous material the polymer as an aqueous dispersion, and subsequently removing the dispersing medium at a temperature within the range of from 0° C. to 70° C., and preferably from 50° C. to 70° C.

4. Method according to claim 3, characterized in that the aqueous or water-dilutable dispersion of the polymer is applied onto the fibrous material by full-bath impregnation, tangential-roll impregnation, spraying, or spreading.

5. Method according to claim 1 or 2, characterized in that the fibrous material is constituted by natural, artificial or synthetic organic fibers.

6. Method according to claim 1 or 2, wherein the fibrous material is constituted by cellulosic fibers, polyacrylic fibers, polyester fibers, aramide fibers, polyamide fibers, or polyolefine fibers.

7. Method according to claim 1 or 2, characterized in that the fibrous material is constituted by inorganic carbon fibers, fiberglass, or asbestos fibers.

* * * * *